US007194786B2

(12) United States Patent
Gagne

(10) Patent No.: US 7,194,786 B2
(45) Date of Patent: Mar. 27, 2007

(54) CARRIER FOR A PAINT TRAY

(75) Inventor: Larry Steven Gagne, Pembroke (CA)

(73) Assignee: T.S. Simms & Co. Limited, Saint John (CA)

( * ) Notice: Subject to any disclaimer, the term of this patent is extended or adjusted under 35 U.S.C. 154(b) by 225 days.

(21) Appl. No.: 10/841,170

(22) Filed: May 7, 2004

(65) Prior Publication Data

US 2005/0194505 A1 Sep. 8, 2005

(30) Foreign Application Priority Data

May 8, 2003 (CA) ..... 2428442

(51) Int. Cl.
*A45C 3/00* (2006.01)

(52) U.S. Cl. ..... 16/406; 16/110.1; 248/110; 248/310

(58) Field of Classification Search ..... 248/310, 248/110, 213.2, 112, 113; 16/110.1, 406, 16/114.1, 422; 220/736
See application file for complete search history.

(56) References Cited

U.S. PATENT DOCUMENTS

| | | | | |
|---|---|---|---|---|
| 2,542,737 | A * | 2/1951 | Vogel | 220/696 |
| 3,108,776 | A * | 10/1963 | Cook | 248/110 |
| 3,947,135 | A | 3/1976 | Hawk | |
| 4,025,205 | A | 5/1977 | Hawk | |
| 4,085,877 | A | 4/1978 | Hildebrand | |
| 4,167,348 | A | 9/1979 | Hawk | |
| 4,890,353 | A * | 1/1990 | Shannon et al. | 15/257.01 |
| 5,062,607 | A * | 11/1991 | Kisner | 248/211 |
| 5,113,549 | A | 5/1992 | Villiano | |
| 5,996,952 | A * | 12/1999 | Heywood | 248/213.2 |
| 6,494,417 | B1 | 12/2002 | Gizzi | |
| 6,609,685 | B1 * | 8/2003 | Lamont | 248/110 |
| 2004/0159752 | A1 * | 8/2004 | Vukas | 248/110 |

FOREIGN PATENT DOCUMENTS

| | | |
|---|---|---|
| CA | 1081145 | 7/1980 |
| CA | 1221057 | 4/1987 |
| CA | 2019101 | 12/1991 |
| CA | 2049600 | 2/1993 |
| CA | 2160168 | 4/1997 |
| FR | 2333584 | 7/1977 |
| WO | WO 02/42007 | 5/2002 |

OTHER PUBLICATIONS

Alta Vista—Babel Fish Translation—Translated Text, 1 page, English translation of the Title in French given in FR 2333584; http://babelfish.altavista.com/tr, Nov. 10, 2004.

* cited by examiner

*Primary Examiner*—Amy J Sterling
(74) *Attorney, Agent, or Firm*—Senniger Powers

(57) ABSTRACT

A carrier for a paint tray is provided, the tray having an inner wall defining a container for containing paint and an outer wall for supporting the container, the inner and outer walls defining a space therebetween accessible from underneath the tray. The carrier comprises a coupler for coupling to the paint tray and a lifting member connected to the coupler. The coupler comprises a coupling member for insertion into the space between said inner and outer wall and having wall engaging means for engaging the interior faces of both said inner and outer walls simultaneously when inserted into said space to secure the member within the space and to support said tray from the coupling member.

13 Claims, 5 Drawing Sheets

CARRIER FOR A PAINT TRAY

FIELD OF THE INVENTION

The present invention relates to a carrier which can be attached to a paint tray to improve the portability of the tray.

BACKGROUND OF THE INVENTION

Examples of known carriers for paint trays or pans are described in U.S. Pat. No. 5,113,549 issued on 19 May 1992 to M. J. Villiano and Canadian Patent No. 2,160,168 issued on 27 Jan. 1998 to Guy Samson. The carrier includes a single upstanding arm which extends over a paint tray, when in use and a coupler for coupling the arm to the tray. The coupler described in U.S. Pat. No. 5,113,549 comprises a clamp which acts between the underside of the tray and the upper edge of the tray wall. The coupler disclosed in CA 2,160,168 engages with a special receptacle provided at the end of a paint tray and which is accessible from above. This document also discloses an alternative coupler comprising a pair of vertically spaced clips which clip to upper and lower edges of the side wall.

However, known paint tray carriers have various drawbacks in that they are either incapable of securely and reliably connecting the carrier to a tray, or they require a tray which is specially adapted for coupling to the carrier.

SUMMARY OF THE INVENTION

According to one aspect of the present invention, there is provided a carrier for a paint tray, the tray having an inner wall defining a container for containing paint and an outer wall for supporting said container, the inner and outer walls defining a space therebetween accessible from underneath the tray, the carrier comprising: a coupler for coupling to the paint tray and a lifting member connected to the coupler, wherein the coupler comprises a coupling member for insertion into the space between said inner and outer wall and having wall engaging means for engaging the interior faces of both said inner and outer walls simultaneously when inserted into said space to secure said member within said space and to support said tray from said coupling member.

According to another aspect of the present invention, there is provided a carrier for a paint tray, the tray having a wall and a rim extending from an upper portion of the wall, the carrier comprising: a coupler for coupling to the paint tray and a lifting member extending from the coupler, wherein the coupler comprises a coupling member for engaging a wall of the paint tray and having an upper surface for engaging the lower surface of the rim extending from said wall, and retaining means for retaining said member in engagement with said tray.

According to another aspect of the present invention, there is provided a carrier for a paint tray, the paint tray having means defining a receptacle which is accessible from below, the carrier comprising a coupler for coupling the carrier to the tray and a lifting member connected to the coupler, the coupler including an upstanding insert member for receipt into said receptacle from below.

According to another aspect of the present invention, there is provided a carrier for a paint tray, the tray having a wall, the carrier comprising a coupler for coupling to the paint tray and a lifting member extending from the coupler, wherein the coupler comprises a coupling member for engaging a wall of the paint tray, and a discrete clamping member for clamping the coupling member to the tray wall.

According to another aspect of the present invention, there is provided a carrier for a paint tray comprising support means for supporting the tray and an arm extending above said support, and at least one holder mounted on said arm for holding a container.

BRIEF DESCRIPTION OF THE DRAWINGS

Examples of embodiments of the present invention will now be described with reference to the drawings, in which.

DESCRIPTION OF EMBODIMENTS

Figure 1:
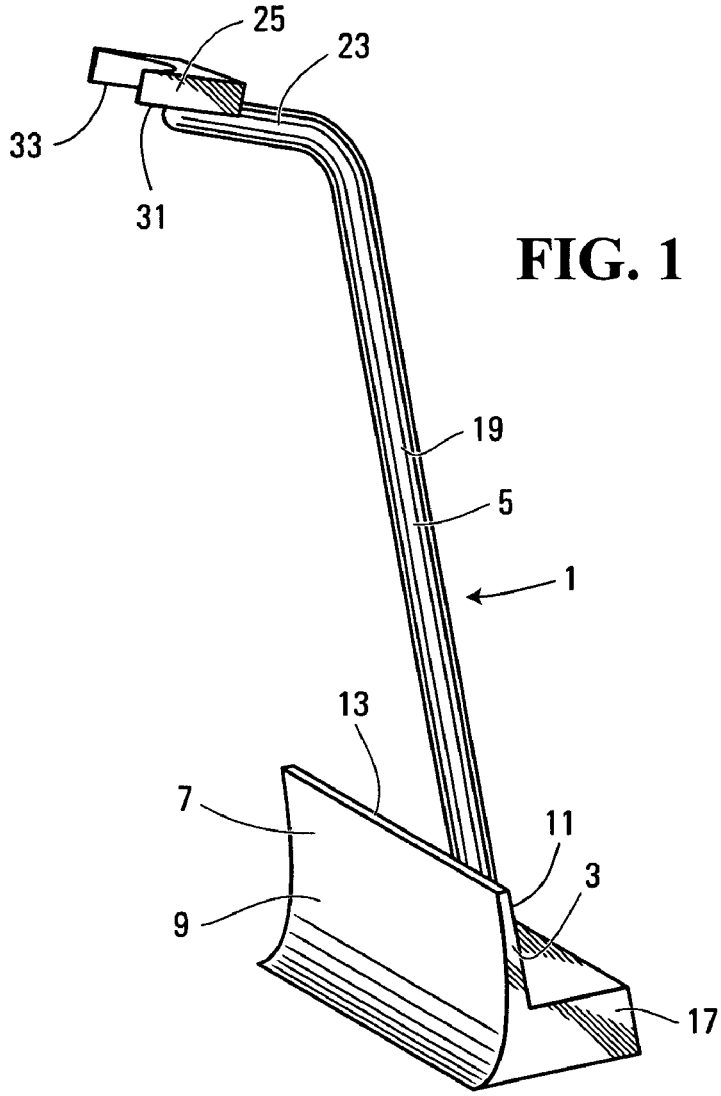
FIG. 1 shows a perspective view of a paint tray carrier according to an embodiment of the present invention.
Figure 2:
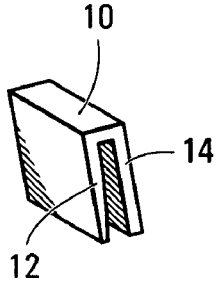
FIG. 2 shows a perspective view of a clip for use with the paint tray carrier of FIG. 1.
Figure 3:
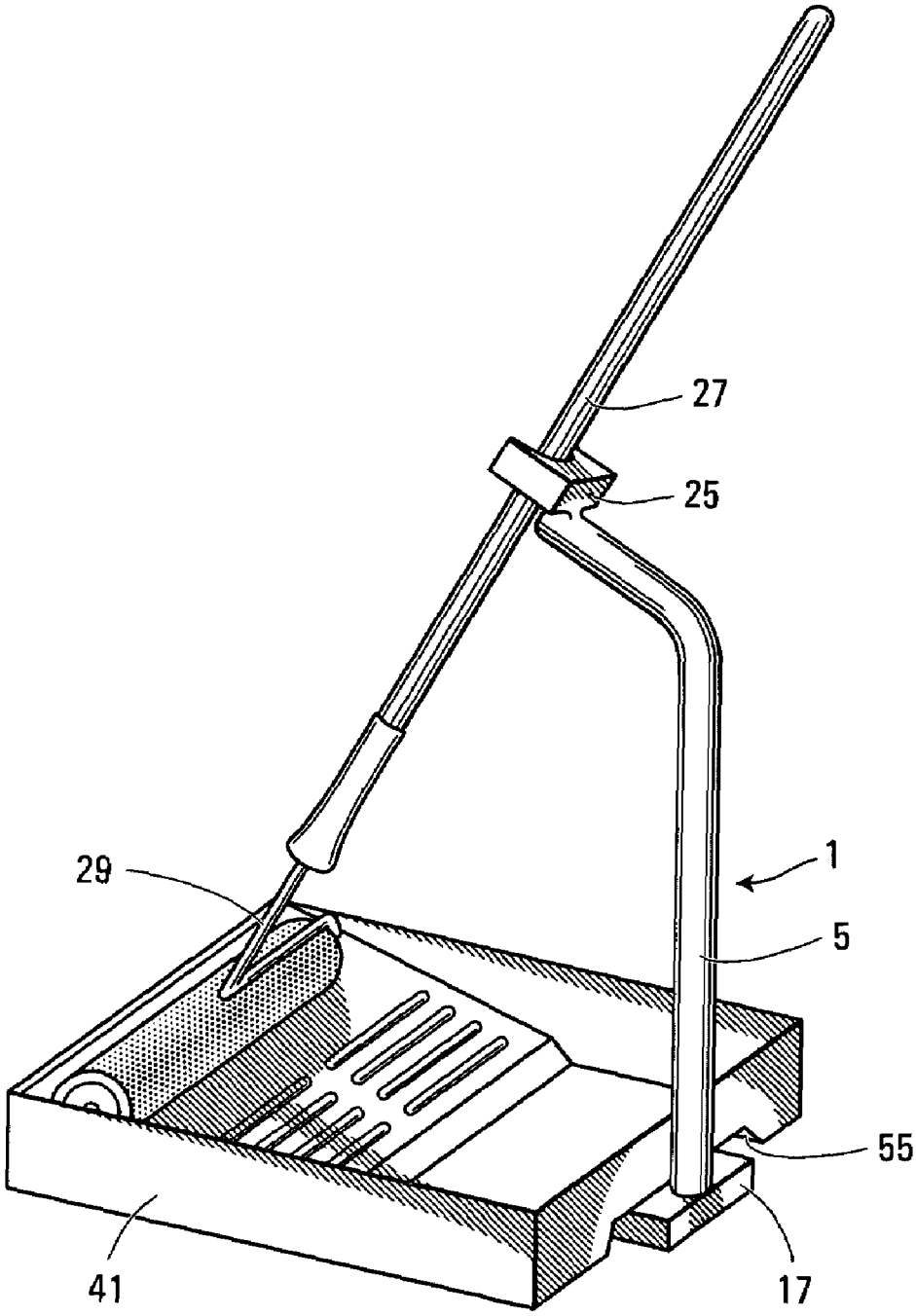
FIG. 3 shows a perspective view of an embodiment of a paint tray carrier attached to a first type of paint tray.
Figure 4:
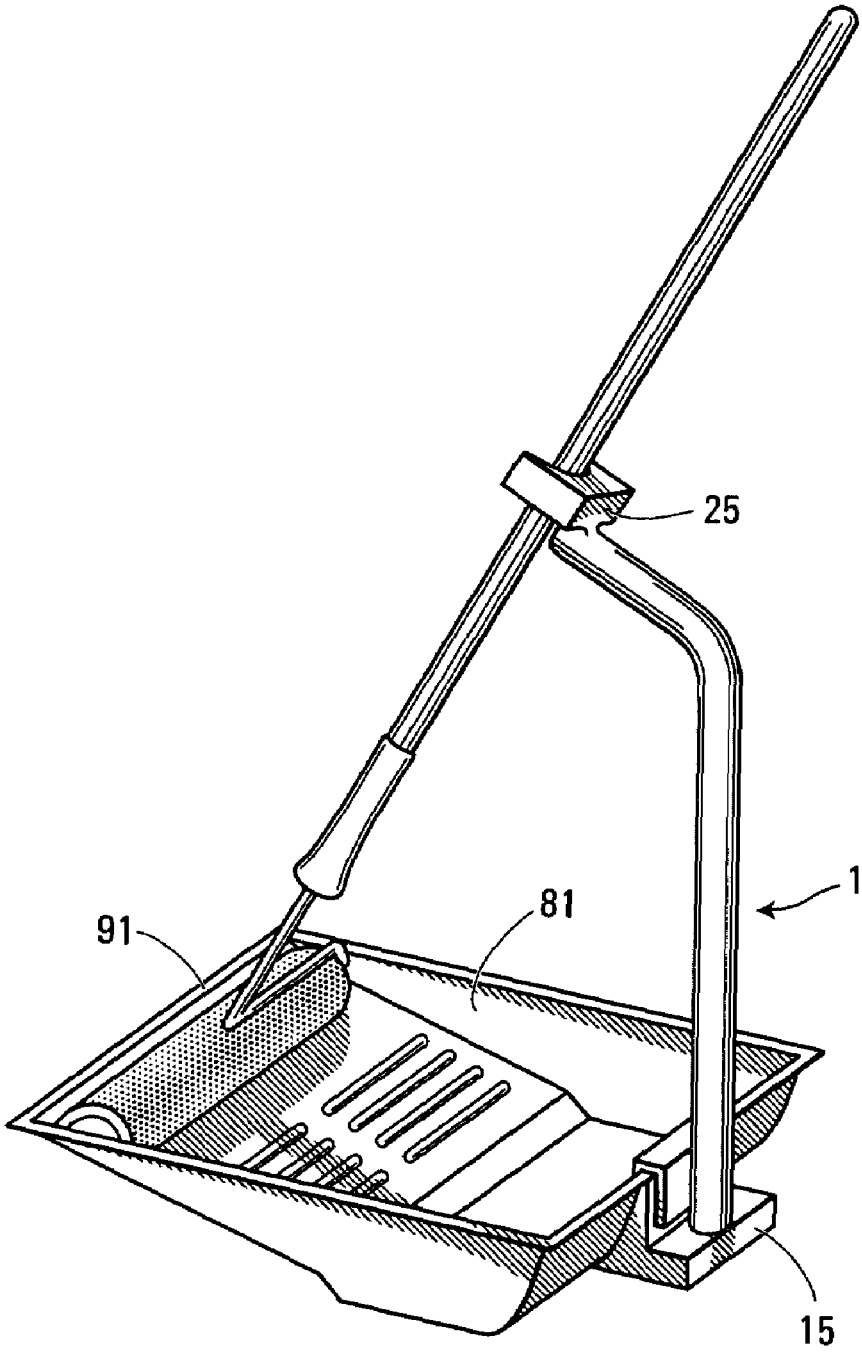
FIG. 4 shows a perspective view of the embodiment of the paint tray carrier shown in FIG. 3 coupled to a paint tray of a second type.
Figure 5:
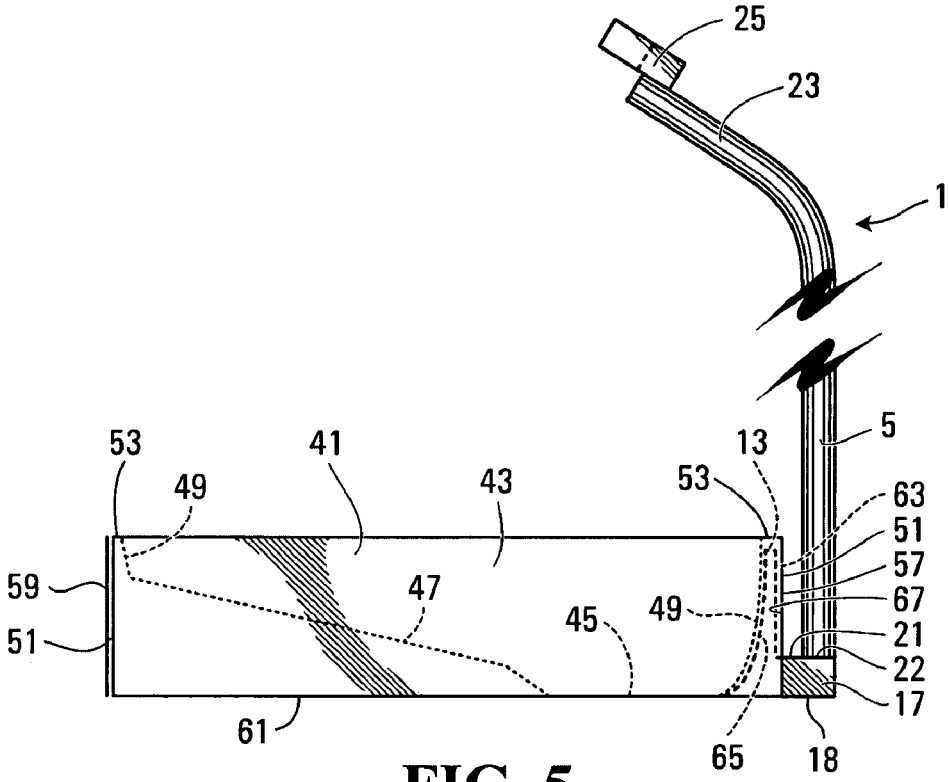
FIG. 5 shows a part sectional side view of a paint tray of the first type coupled to an embodiment of a paint tray carrier.
Figure 6:
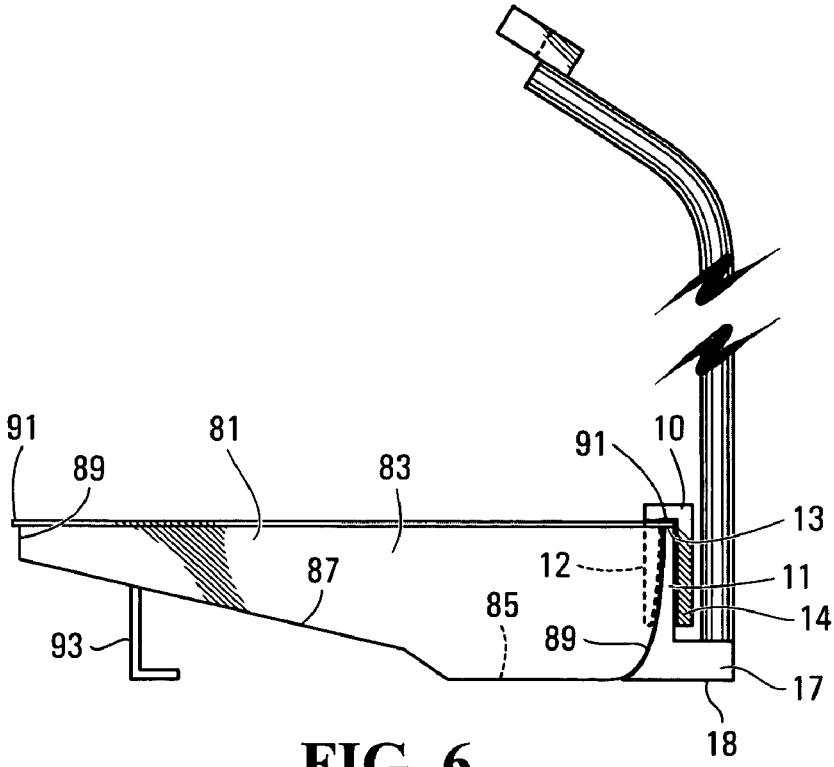
FIG. 6 shows a part cross-sectional side view of a paint tray of a second type coupled to the embodiment of the paint tray carrier shown in FIG. 5.

Referring to FIGS. 1 to 6, a carrier 1 for a paint tray according to an embodiment of the present invention comprises an L-shaped coupler 3 for coupling to a paint tray and a lifting member 5 extending from the coupler. The coupler includes an upstanding front leg or coupling member 7 having a concave front face 9, a rear face 11, a top 13 and a bottom 15. In this embodiment, the concave front face 9 of the coupling member is shaped so that at least portions of the front face which are spaced apart between the top 13 and bottom 15 of the coupling member can engage the wall of a paint tray, as for example shown in FIGS. 5 and 6. The coupler 3 includes a basal leg 17 which extends rearwardly of the coupling member 7 for supporting the paint tray carrier on a floor or other horizontal surface. The lifting member 5 comprises an arm 19 which extends upwardly from the basal leg 17 and which is connected to the basal leg to provide a gap 21 between the rear face 11 of the coupling member 7 and the arm 19, as shown in FIGS. 5 and 6. Advantageously, in one embodiment, the basal leg of the carrier is adapted to support the carrier arm 19 in an upright position when detached from a tray and without other assistance to facilitate attachment of the carrier to a paint tray, and in particular to allow a user to set the carrier into an upright position before attaching it to a tray without having to hold the carrier either before or during its attachment to a tray. The basal leg also assists in stabilizing the tray/carrier assembly, helps to prevent tipping of the tray and supports the weight of the carrier directly and independently of the tray.

In this embodiment, an upper portion 23 of the lifting arm 19 is angled to extend forward over a paint tray, when the carrier is attached thereto and includes an end portion 25 for supporting the handle 27 of a paint roller 29, as for example shown in FIGS. 3 and 4. In this embodiment, the end portion 25 has lower surfaces 31, 33 which extend either side of the arm 23 to enable the arm to be lifted by two fingers positioned below the end portion 25. A slot 33 is formed in the end portion for receiving a paint roller handle 27 to prevent sideways movement thereof.

FIGS. 3 to 6 illustrate how the same paint tray carrier according to an embodiment of the present invention can be attached to two different types of paint trays. In particular, FIGS. 3 and 5 show the carrier attached to one type of common paint tray which is generally moulded from a plastic material and FIGS. 4 and 6 show the carrier attached to a paint tray of a common, pressed metal type.

Referring to FIGS. 3 and 5, the first type of paint tray 41 comprises a container 43 having a paint well 45, a ramp 47 (which may include ribs, not shown) and an inner wall 49. The paint tray further includes an outer wall 51 which supports the container 41 and which is attached to the upper portion of the inner wall for example by a rim or web 53. A slot 55 (shown in FIG. 3) is formed in the lower part of the rear outer wall 57, and possibly also in the lower part of the front outer wall 59, for receiving fingers of a user so that a lower edge of the outer wall is manually accessible to a user when the paint tray is resting on a floor to facilitate lifting and moving the paint tray.

To attach the tray 41 to the carrier 1, the bottom edge 61 of the tray is simply raised above the level of the top 13 of the coupling member 7, the space 63 between the inner and outer walls 49, 57 of the tray is positioned over the coupling member 7 and the tray is then lowered over the coupling member so that the front face 9 of the coupling member engages the inner face 65 of the inner wall 49 and the rear face 11 of the coupling member 7 engages the inner face 67 of the outer wall 51 of the paint tray.

The coupling member is preferably adapted to engage both the inner and outer walls of the paint tray simultaneously and fit relatively snugly or tightly therebetween and to prevent any significant rotation of the paint tray about the coupling member due to its weight when the carrier is lifted. The coupling member 11 should also extend sufficiently into the space so that portions of the coupling member which engage the inner and outer walls of the tray are sufficiently spaced apart between the top and bottom of the tray to prevent significant rotation of the tray due its weight when the carrier is lifted.

The coupling member may be sized so that when inserted into the space, it moves the inner and outer walls of the container apart, at least slightly, so that the resiliency of the tray walls assist in retaining the coupling member within the space when the tray is lifted other than by means of the carrier, without the carrier falling out. The paint tray wall engaging surfaces of the coupling member may also be adapted to produce friction with the container walls, again to assist in retaining the coupling member within the space and to support the weight of the carrier. Although in one embodiment, the front and rear faces of the coupling member may be adapted to substantially conform with the profile of the inner faces of the inner and outer walls of a paint tray, in other embodiments, the coupling member may include protrusions, for example resilient protrusions for engaging with the inner faces of the inner and outer walls to allow the coupling member to conform to different shapes and profiles of inner and outer walls of different paint trays and different shaped gaps between the inner and outer walls.

Double-walled paint trays may have webs of material within the space between the inner and outer walls and which, for example, extend between the inner and outer walls thereby forming a bridge connecting the walls together for additional strength. Furthermore, paint trays may have other formations which also extend into the space and which potentially provide an obstruction to inserting the coupling member into the space. Embodiments of the coupling member may be adapted to avoid these webs or other protrusions by shaping the coupling member appropriately, and such shaping may for example include forming slots or recesses within the coupling member to accommodate the various protrusions.

The coupling member is preferably adapted so that when inserted into the space between the inner and outer walls of a paint tray to the extent necessary to properly secure the carrier to the tray, the lower surface or bottom 15 of the coupler lies substantially flush with floor engaging portions of the tray or extends below the tray to some degree so that, when in use, the carrier is independently supported by the floor.

In one embodiment, the upper surface 22 of the basal leg 17 of the coupler may be positioned to engage the lower edge of the outer wall of the tray or so that the lower edge is near the upper surface so that the basal leg can provide additional support for the tray at the lower edge of its outer wall.

Referring to FIGS. 4 and 6, the second type of paint tray 81 with which the carrier 1 may be used comprises a container 83 having a paint well 85, a ramp 87, a container wall 89 and a rim 91 extending outwardly from the upper edge of the container wall 89. The tray 81 also includes a foot or feet 93 positioned below the ramp 87 for supporting the front end of the tray and to keep the tray level when supported on a horizontal surface.

To attach the carrier 1 to the tray, the coupling member 11 of the carrier is positioned adjacent the wall 89 of the tray and so that the top 13 of the coupling member is positioned below the rim 91, as shown in FIG. 6. Thereafter, a clip or clamping member 10 is pushed downwards over the top of the container wall so that one jaw 12 of the clip engages the container wall and the second jaw 14 of the clip engages the rear surface 11 of the coupling member 7 to urge and retain the coupling member against the container wall.

The strength of the coupling between the tray and the coupling member will depend on the resiliency of the clip and also the extent to which the jaws of the clip extend over the wall of the tray and over the rear wall of the coupling member. In the present embodiment, the clip extends downwards over a substantial portion of the height of the tray wall and over a substantial portion of the height of the rear wall of the coupling member. However, in other embodiments, the jaws of the clip may extend downwards by a lesser or greater degree.

Advantageously, since the clip is free to move up and down by any required extent, not only is attachment of the carrier to the paint tray greatly facilitated over prior art arrangements, but the jaws of the clip can be relatively long thereby substantially increasing the strength of the coupling, again in comparison to prior art arrangements where the resiliency of the clip which is responsible for the coupling between the carrier and tray must be sufficiently flexible to allow the clip to be bent manually in order to connect the tray to the carrier.

In this embodiment, the top 13 of the coupling member can support the tray from the rim 91. However, in other embodiments the top of the coupling member need not engage the rim and the tray may be supported simply by virtue of friction between the tray wall and the coupling member when the wall and coupling member are forced together by means of a suitable retainer, for example, a clamping member or clip as shown for example, in FIGS. 2, 4 and 6. If necessary, the friction of the surface of the tray and/or coupling member may be enhanced by any suitable means, for example, by treating the surface with a suitable treatment or texturing the surface, for example, by knurling or otherwise providing surface structure.

It is to be noted in the embodiments shown in FIGS. 5 and 6, the front face 9 of the coupling member has an upper face portion defining a substantially vertical surface. The lower portion of the coupling member 7 generally curves or flares forwards such that the most forward extent of the front face is proximate a bottom of the coupler so that the front face is shaped to conform with and engage at least a portion of he curved lower part of the container wall which adjoins the floor of the paint well 45, 85. This feature may assist in supporting the tray when lifted by the carrier.

As for the embodiment shown in FIG. 5, the coupler is preferably adapted so that it is coupable to the tray in such a manner that the base 15 of the carrier lies substantially flush with the floor engaging parts of the tray or extends below the floor engaging parts of the tray so that the carrier can be supported directly by a horizontal surface and independently of the tray. Advantageously, this helps to stabilize the carrier and tray when connected together and prevents the carrier from contributing to a moment of the combined carrier/tray assembly which would otherwise tend to tip the tray forwards towards the carrier.

Although in the embodiments described above, the carrier is shown connected to the rear end of the paint trays, it will be appreciated that the carrier may be connected to any other portion of the paint tray wall, for example, one of the side walls, or the front wall.

Figure 7:
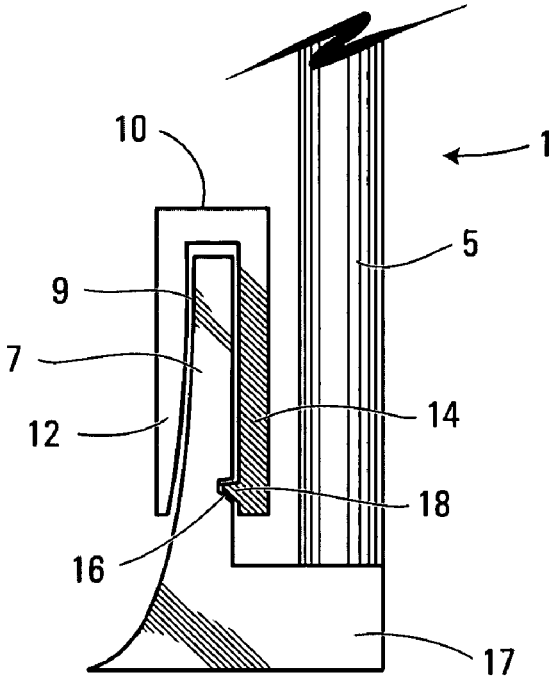
FIG. 7 shows a cross-sectional view through an embodiment of a clip for use with a coupler according to an embodiment of the present invention.

FIG. 7 shows an embodiment of a clamp member or clip 10 which includes a detent arrangement 16, 18 for locking the second jaw 14 of the clip to the coupling member 7. In this particular embodiment, the detent arrangement comprises a recess 16 formed in the rearward face 11 of the coupling member and a corresponding protrusion 18 protruding from the inner face of the second clip jaw 14. In other embodiments, the protrusion may be formed on the coupling member and the recess formed on the clip. However, this latter arrangement, in which the protrusion is formed on the coupling member, may interfere with the coupling member's ability to adapt to double walled paint trays, as shown in FIG. 5 in which the rear face engages with the outer tray wall. In other embodiments, any other form of suitable detent arrangement may be included or a detent arrangement may be omitted altogether.

The clip may be formed from any suitable material including metal, for example sheet metal of a suitable thickness and having the desirable resilience or from a plastics material, or from any other suitable material.

Figure 8:
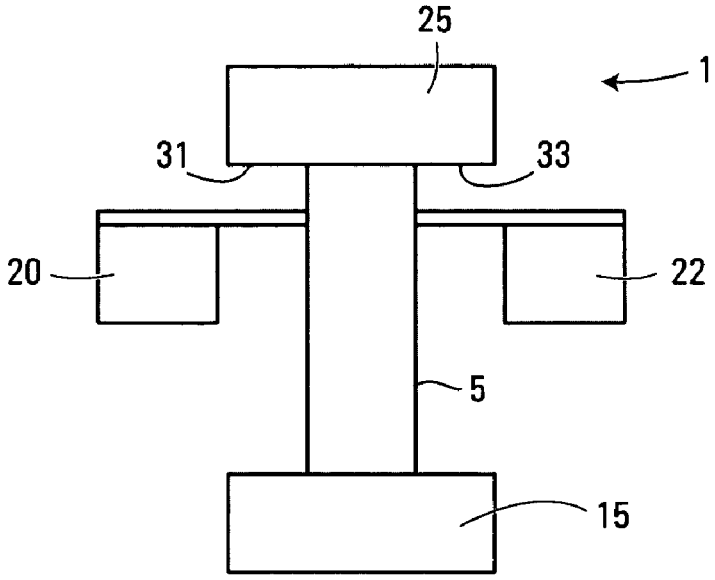
FIG. 8 shows a rear view of a carrier in accordance with another embodiment of the present invention.

FIG. 8 shows a rear view of an embodiment of a carrier 1 and like features are designated by common reference numerals. The carrier further includes at least one holder 20, 22 supported by and extending from the carrier arm 5 and which may be adapted to support at least one of a paint can and a beverage container such as a cup, mug or flask. Advantageously, the base 15 of the carrier supports the weight of the container(s) independently of the tray.

The coupler and lifting member, e.g. the carrier arm may be formed of any suitable material or combination thereof, including plastics, metal or wood. In one embodiment, the lifting member may be arranged to swivel relative to the coupler so that any angled upper portion of the arm which for example provides a carrying handle or is used for supporting the handle of a paint roller can be rotated away from an overhanging position above the tray.

Modifications and changes to the embodiments described herein will be apparent to those skilled in the art.

What is claimed is:

1. A carrier for a paint tray, comprising:

a generally L-shaped coupler with an upstanding front leg extending upwardly from a rearwardly extending basal leg;

a lifting member extending upwardly from said basal leg in spaced relation from said front leg, said lifting member meeting said basal leg rearwardly of said front leg;

said upwardly extending front leg having a concave front face with an upper face portion defining a substantially vertical surface and a lower face portion flaring forwardly such that the most forward extent of said front face is proximate a bottom of said coupler such that said front face conforms to the shape of a side wall of a paint tray.

2. The carrier of claim 1 wherein said front leg has a rear face defining a generally vertical surface.

3. The carrier of claim 2 wherein said lifting member terminates in a receptor for holding a paint roller handle.

4. The carrier of claim 3 wherein said receptor is a notch.

5. The carrier of claim 1 further comprising a retainer for, when said front leg engages said paint tray, retaining said front leg in engagement with said paint tray.

6. The carrier of claim 5 wherein said retainer is a clip for clipping said front leg to a wall of a paint tray.

7. The carrier of claim 6 wherein said clip is a separate clip and wherein said clip is U-shaped and has a detent and said rear face of said front leg has a notch for receiving said detent.

8. The carrier of claim 3 wherein said lifting member supports a paint can holder.

9. The carrier of claim 3 wherein said lifting member comprises a rod extending from said basal leg, said rod having a medial bend such that said receptor projects forwardly of said coupler.

10. The carrier of claim 2 wherein said coupler is sized so that when said coupler is inserted into a space between a curved inner wall and an outer wall of a paint tray of a type wherein said curved inner wall defines a container for containing paint and said outer wall is for supporting said container, said concave front face engages the curved inner wall and said rear face engages said outer wall.

11. The carrier of claim 10 wherein said coupler is sized so that, when fully inserted into said space, a bottom of said coupler extends to or below a bottom of said tray.

12. The carrier of claim 3 wherein said concave front face and top surface of said basal leg of said coupler are configured to mirror a curved wall and a rim extending from an upper portion of said curved wall of a paint tray of a type wherein said curved wall defines a container for containing paint and said rim stiffens said curved wall and further comprising a clip for retaining said coupler in engagement with said tray.

13. The carrier of claim 12 wherein said coupler is sized so that, when clipped in engagement with said tray, a bottom of said base extends to or below a bottom of said tray.

* * * * *